US005568907A

United States Patent [19]

Wolfe et al.

[11] Patent Number: 5,568,907

[45] Date of Patent: Oct. 29, 1996

[54] DYNAMIC WRIST REST

[76] Inventors: Jimmy V. Wolfe, 4233 Jernigan Rd.; Bruce L. Williams, 1119 Stillhouse Rd., both of White House, Tenn. 37188

[21] Appl. No.: 430,750

[22] Filed: Apr. 27, 1995

[51] Int. Cl.[6] ..... B68G 5/00

[52] U.S. Cl. ..... 248/118; 248/918

[58] Field of Search ..... 248/118, 118.1, 248/118.3, 118.5, 918; 400/715, 719; 267/117, 142

[56] References Cited

U.S. PATENT DOCUMENTS

| | | | |
|---|---|---|---|
| 4,688,862 | 8/1987 | Fowler et al. | 248/118.3 |
| 5,147,090 | 9/1992 | Mandell et al. | 248/118.1 |
| 5,158,255 | 10/1992 | Fuller | 248/118 |
| 5,165,630 | 11/1992 | Connor | 248/118.1 |
| 5,234,186 | 8/1993 | Powell | 248/118.1 |
| 5,348,408 | 9/1994 | Gelardi et al. | 248/118.1 |
| 5,356,099 | 10/1994 | Sereboff | 248/118.1 |
| 5,435,508 | 7/1995 | Deuitch et al. | 248/118 |
| 5,445,349 | 8/1995 | Hart | 248/118 |
| 5,467,952 | 11/1995 | Martin | 248/118.1 |

FOREIGN PATENT DOCUMENTS

| | | | |
|---|---|---|---|
| 9308033 | 4/1993 | WIPO | 248/118.1 |
| WO93/21019 | 10/1993 | WIPO | 248/118.1 |

*Primary Examiner*—Ramon O. Ramirez

*Attorney, Agent, or Firm*—I. C. Waddey, Jr.; Waddey & Patterson

[57] ABSTRACT

A dynamic wrist rest for use with a computer keyboard for the prevention of carpel tunnel syndrome is provided. The wrist rest provides for a constant up and down motion of the wrist through an internally mounted pressure sensitive air bladder. The up and down motion can also be provided by a motor and gear driven belt and pulley system that provides a lower speed and high torque which functions to rotate a roller along the interior surface of the support surface of the wrist rest thus creating the up and down motion. The up and down motion can also be provided by a motor driven, internally mounted oblong roller that is mounted for rotation about its axis.

6 Claims, 6 Drawing Sheets

DYNAMIC WRIST REST

BACKGROUND OF THE INVENTION

The present invention relates generally to a wrist rest and more particularly to a dynamic wrist rest for use with existing computer keyboards or incorporation into new keyboards on computers.

It will be appreciated by those skilled in the art that carpel tunnel syndrome can be developed by a worker who performs the same hand movements over and over. For example, this syndrome can be developed from the constant use of a computer keyboard. Without movement of the position of the hands, inflammation of the flexor tendons of the fingers or hand can occur. The tendons swell, which compress on nerves and lead to nerve damage. Ultimately, this nerve damage can result in the loss of the use of the thumb or fingers.

To this end, there have been several attempts to develop wrist rests to combat the problem of carpel tunnel syndrome. One such attempt was disclosed in U.S. Pat. No. 4,688,862 issued to D. Fowler, et al. on Aug. 25, 1987. This patent discloses a statically adjustable wrist rest system with an upward vertical support to offset the downward pressure placed upon the rest by the user's hands and arms. The disclosure of this patent is exemplary of the prior art in that it discloses a static wrist rest.

The problem with the static wrist rest is that it does not provide the range of motion necessary to adequately combat carpel tunnel syndrome. Even if the static wrist rest is adjustable, workers often do not take the time to adjust it. What is needed, then, is a wrist rest wherein the wrist interface is constantly moving to provide different angles for the hands as the typist works. This device is presently lacking in the prior art.

SUMMARY OF THE INVENTION

The wrist rest of this invention will automatically change the wrist position and angle of use in order to lessen the fatiguing effects of repetitive motion in a static posture.

The dynamic wrist rest of this invention comprises a housing having an internal void space; a wrist interface on the top outer surface of the housing; and means to constantly move the wrist interface up and down. The means can be mounted within the internal void space of the housing.

The means to move the wrist interface up and down can further comprise an expandable bladder having a port providing for the intake of air into and out of the bladder, the port passing from the exterior of the housing to the interior of the housing and through a wall of the bladder to an interior void space of the bladder, the wall of the bladder contacting an interior surface of the wrist interface; and means for regulating the flow of air into and out of the bladder as pressure is applied to the wrist interface.

The means to move the wrist up and down can also comprise an externally mounted motor, a drive train consisting of one or more gears for reducing the speed of rotation of the power output shaft of the motor, a series of pulleys rotatably in the system and driven by the power output of the driven gears, a series of belts mounted between the pulleys, and a roller mounted between the belts so that the belts move the roller around the pulleys, the roller mounted in a position such that the roller contacts the interior surface of the housing.

The means to move the wrist up and down can also comprise an internally mounted oblong roller, the oblong roller mounted such that it contacts an interior surface of the wrist interface, an externally mounted motor, and a gear train designed to drive the oblong roller so that the rotation of the oblong roller will cause the wrist rest to move up and down.

The incidence of wrist, forearm and hand syndromes associated with a repetitive motion in a static position will be lessened by the use of this device. Examples of the wrist, forearm and hand syndromes that can be addressed by use of this device include, but are not limited to, carpel tunnel syndrome, ulnar neuropathy, radial sensory neuropathy, tendinitis, ligamentous inflammation and inflammation of the periosteum.

DESCRIPTION OF THE PREFERRED EMBODIMENT

Figure 1:
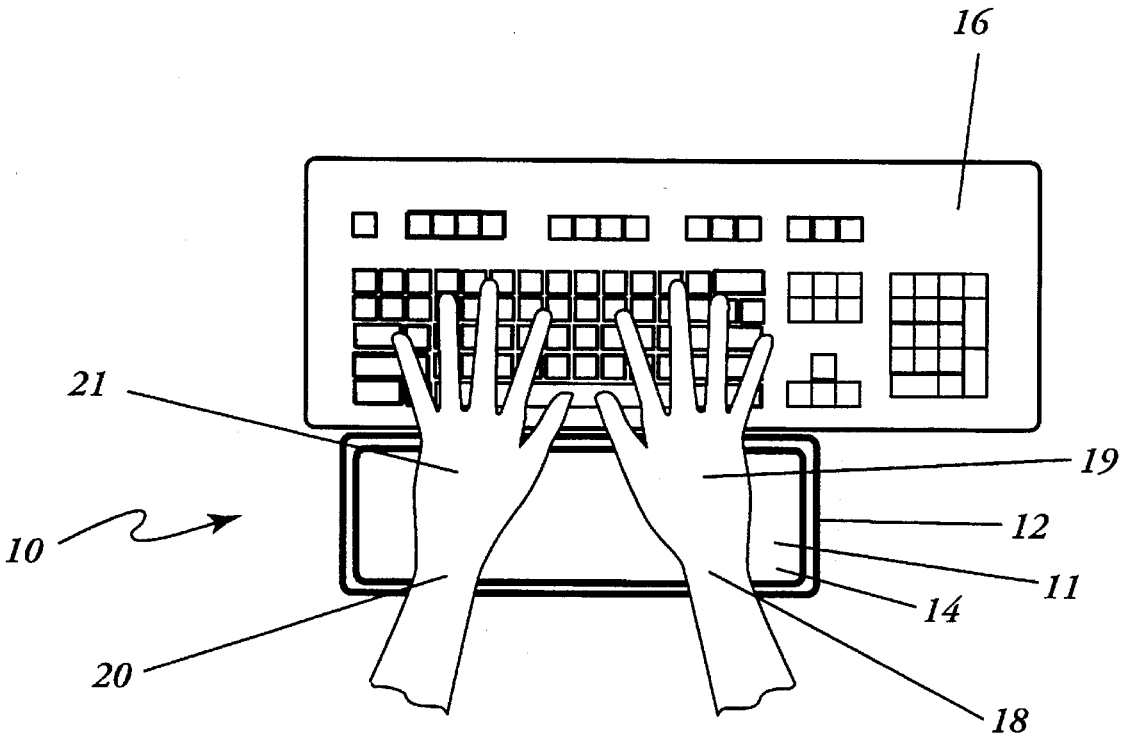
FIG. 1 is a plan view depicting the preferred placement of the dynamic wrist rest in relation to a keyboard.
Figure 2:
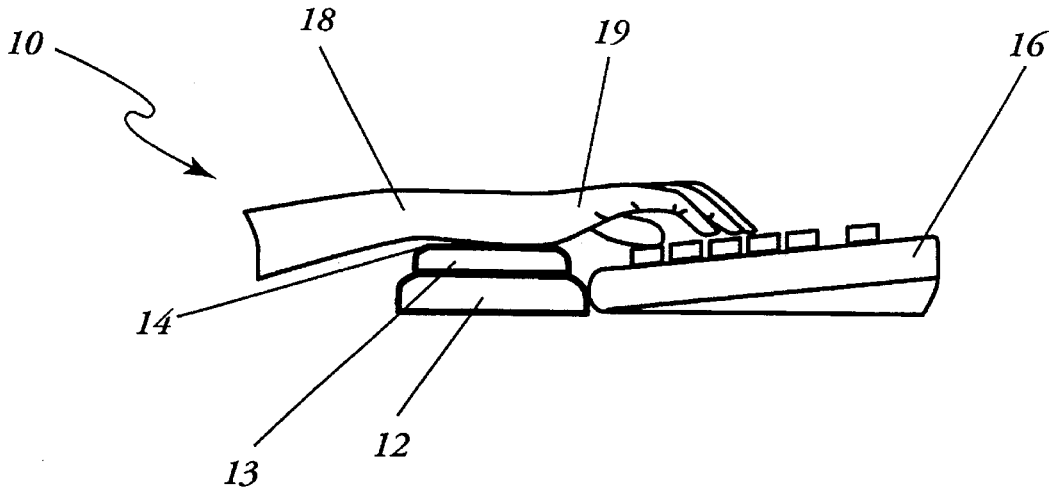
FIG. 2 is a right side view depicting the dynamic wrist rest in one position.

Referring now to the drawings, the dynamic wrist rest is referred to generally as 10. In FIG. 1, the preferred placement of the dynamic wrist rest 10 in relation to a computer keyboard 16 is depicted. The wrist rest 10 will normally be placed between the user and the keyboard 16. The wrist rest 10 includes housing 11 and wrist interface 14. Wrist interface 14 forms the top surface of housing 11. As best seen in FIG. 2, housing 11 preferably includes a base 12 and an wrist interface support wall 13. Base 12 supports wrist interface support wall 13 from below and wrist interface support wall 13 supports wrist interface 14 from below. Base 12 preferably supports wrist interface support wall 13 around the entire periphery of wrist interface support wall 13. Wrist interface support wall 13 preferably supports wrist interface 14 around the entire periphery of wrist interface 14.

Referring again to FIG. 1, the placement of a user's wrist and hands on the device is illustrated in detail. User's right wrist 18 and user's left wrist 20 rest on wrist interface 14. More specifically, the heel of the user's palm rests on the wrist interface 14 which in turn supports the user's wrists. User's right hand 19 and user's left hand 21 are oriented in a position such that the user can access the keys of keyboard 16.

Figure 3:
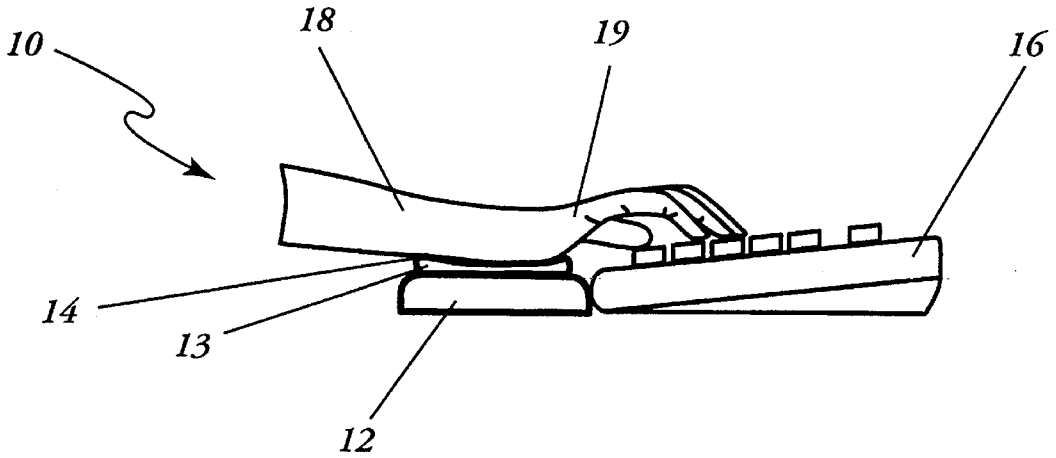
FIG. 3 is a right side view depicting the dynamic wrist rest in another position.

Referring now to FIGS. 2 and 3, the action of dynamic wrist rest 10 is depicted. Wrist interface 14 is depicted at one vertical position in FIG. 2 and at a second vertical position in FIG. 3. Thus, dynamic wrist rest 10 moves right wrist 18 up and down constantly as right hand 19 is being used to type on computer keyboard 16. Left wrist 20, which is not shown, is also moved up and down constantly by the wrist rest 10. It is this constant change in vertical position that prevents carpel tunnel syndrome.

Figure 4:
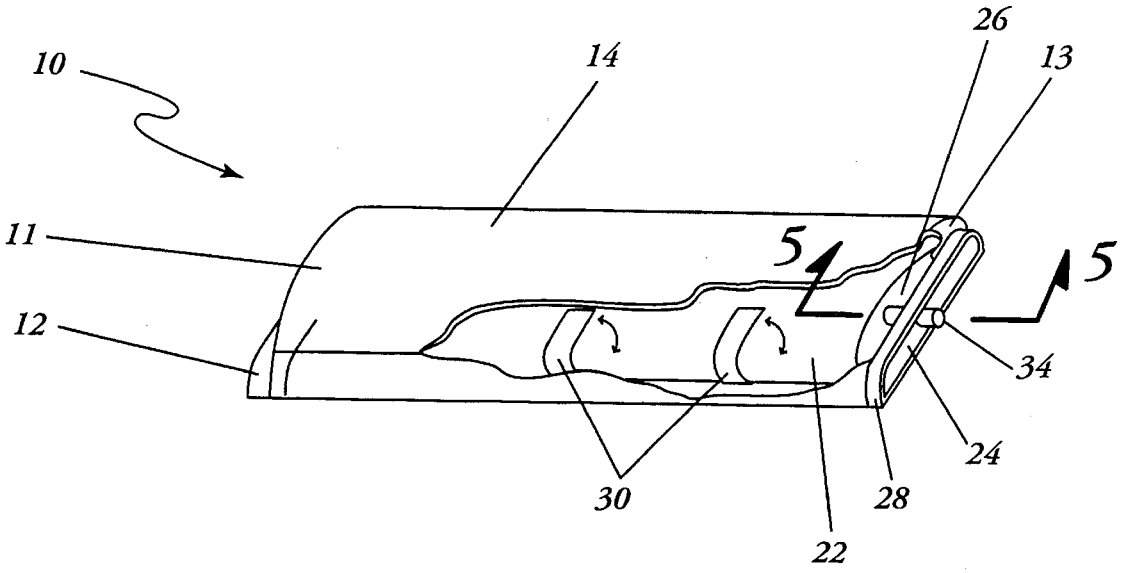
FIG. 4 is a cut-away view of the internal bladder in the pressure-sensitive manual embodiment of the dynamic wrist rest.

Referring now to FIG. 4, a particular embodiment of dynamic wrist rest 10 is depicted. This embodiment of wrist rest 10 works manually using a pressure sensitive bladder 22. FIG. 4 illustrates the exterior of air intake port 34. The port 34 passes through partition wall 28 which separates chamber 24 and inner chamber 26. Inner chamber 26 is inside housing 11 and bladder 22 fits within the inner chamber.

Expansion springs 30 are at rest in an open position biased in the direction of the arrows shown in FIG. 4. The springs 30 are glued or otherwise connected to the bladder 22 so that as the springs open, they expand the bladder and draw air in through the valve described hereinafter. Pressure of the heels of the user's hands pushing down on the wrist interface 14 compresses the springs 30, tending to force air out of the bladder. However, because of the operation of the valve that controls the intake and output of air into and out of the bladder, the pressure will cause the bladder to collapse slowly; thereby allowing the wrists to follow a controlled downward path. When the user lifts his or her hands during the course of operation of the key board, the springs will cause the bladder to re-fill quickly, thus raising the support for the heels of the user's hands, thereby changing the angle of the wrists for the next several minutes of operation of the user at the keyboard.

Figure 5:
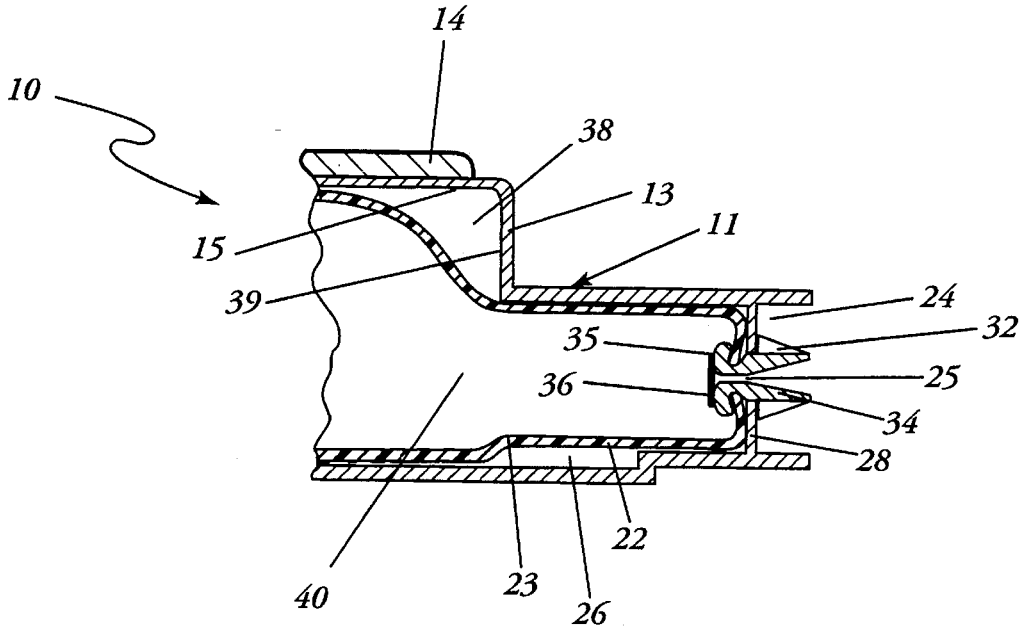
FIG. 5 is a cross sectional view from the front of the dynamic wrist rest of the air intake port.

Referring now to FIG. 5, the details of intake port 34 and the control valve 32 are disclosed. Air intake port 34 has inserted through it the valve 32. Valve 32 is securely fastened to the partition wall 28. As described above, partition wall 28 separates outer chamber 24 and inner chamber 26. FIG. 5 also depicts void space 38. This void space 38 lies between bladder 22 and the interior surface 39 of housing 11. Void space 38 allows for the expansion and contraction of bladder 22.

Port 34 passes through partition wall 28 to the interior of housing 11 then through the wall 23 of bladder 22 to the interior void space 40 of bladder 22. Flap 36 is pivotally mounted at 35 at the inside orifice 25 of valve 32. The flap allows air to freely inter the bladder when the springs 30 expand to their at rest position (raising the wrist interface 14), but the flap obstructs the exit of the air due to the pressure of the wrists of the user on the device. Thus, valve 32 regulates the flow of air into and out of bladder 22. This valve is not new, and a number of valves designed to perform a similar function are commercially available.

Pressure applied to wrist rest 10 through wrist interface 14 causes bladder 22 to be expand in one area and contract in another. Bladder wall 23 contacts the interior surface 15 of wrist interface 14 as bladder 22 expands and contracts, thus providing the vertical motion of wrist interface 14.

Figure 6:
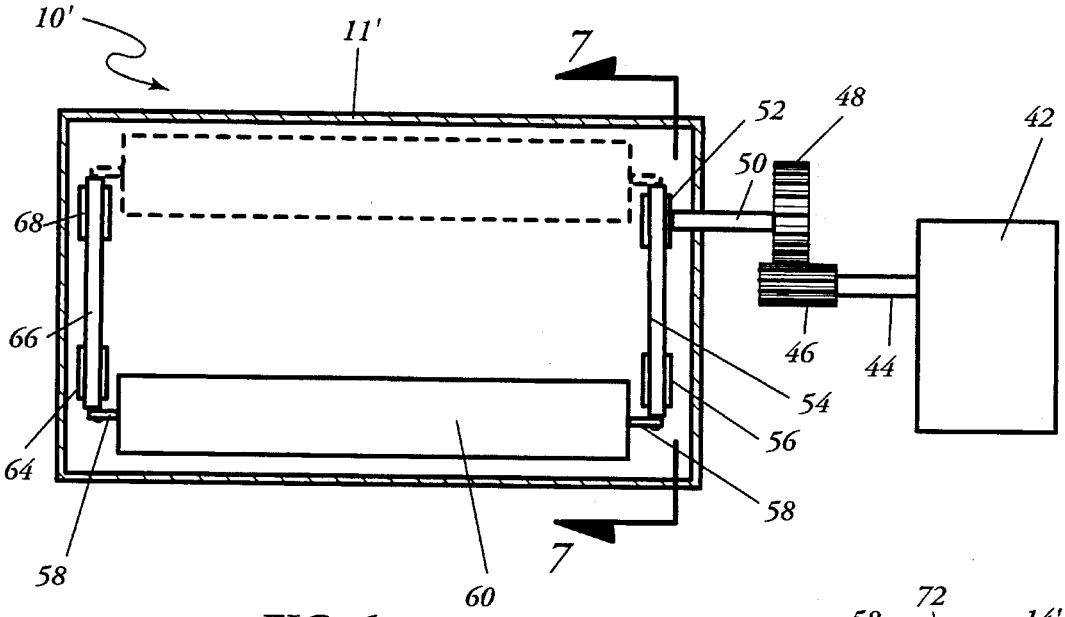
FIG. 6 is an internal view of a motorized embodiment of the dynamic wrist rest.
Figure 9:
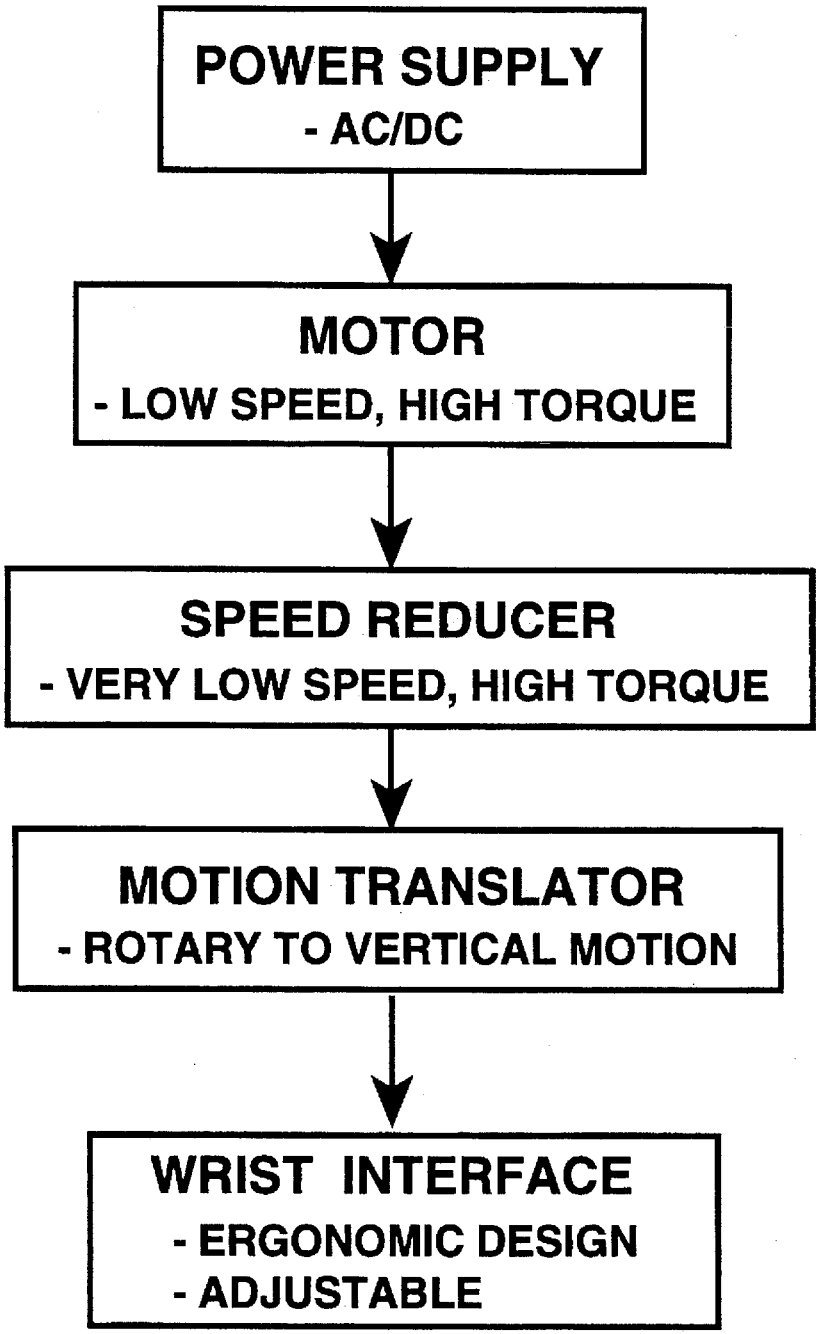
FIG. 9 is a schematic of the motorized embodiment of the dynamic wrist rest.

Referring now to FIG. 6, a motorized embodiment 10' of wrist rest is illustrated. Motor 42 drives the motorized embodiment 10'. Motor 42 is connected to a power supply which can be AC or DC and is not shown. Preferably, motor 42 is low speed, high torque motor as described in the schematic in FIG. 9. Please note that in FIG. 6, motor 42 and the other structures are depicted on the right hand side of motorized wrist rest 10', but a person having ordinary skill in the art could clearly mount this assembly on the left side and as such any references to side or location of the motor and assemblies are merely for clarity of description and should not be construed as limitations.

Motor 42 is connected to and drives first shaft 44. Shaft 44 is connected to and turns gear 46. Gear 46 interacts with speed reducing gear 48 to turn gear 48. Preferably, speed reducing gear 48 is larger than gear 46 to reduce speed and increase torque as described in the schematic of FIG. 9. Speed reducing Gear 48 is connected to and turns speed reducing gear shaft 50. Speed reducing gear shaft 50 passed from the exterior to the interior of housing 11' where it is attached to motion translator 78.

Figure 8:
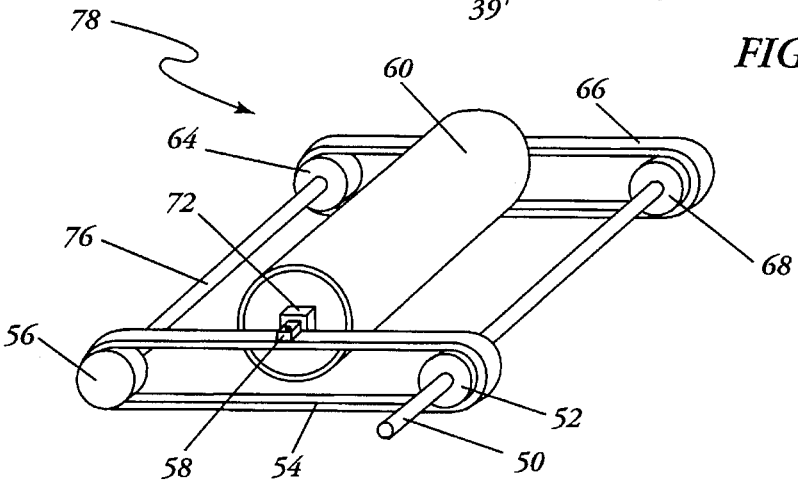
FIG. 8 is a plan view of the motion translator of the motorized embodiment of the dynamic wrist rest.

Referring now to FIG. 8, the motion translator 78 of motorized wrist rest 10' is shown. Preferably, motion translator 78 is a substantially rectangular assembly including belts, pulleys and a roller. Speed reducing gear shaft 50 is rotatably connected to first pulley 52 as it passes through the center of first pulley 52 and preferably spans the length of motion translator 78 to fourth pulley 68. Speed reducing gear shaft 50 is rotatably mounted to fourth pulley 68 at the center of fourth pulley 68.

Second pulley 56 is spaced away from first pulley 52 for the width of motion translator 78. The line along which first and second pulleys 52, 56 lie is substantially perpendicular to the line of shaft 50. First drive belt 54 is mounted between first and second pulleys 52, 56, and second drive belt 66 is mounted between third and fourth pulleys 64, 68.

A pulley connector shaft 76 spans the length of motion translator 78 and is rotatably mounted between second pulley 56 and third pulley 64 at the centers of second and third pulleys 56, 64. Third pulley 64 is in line with second pulley 56. The line along which the axes of second and third pulleys 56, 64 lie is substantially perpendicular to the line along which first and second pulleys 52, 56 lie.

Fourth pulley 68 is spaced away from third pulley 64 for the width of the motion translator 78 and is in line with third pulley 64. The line along which third and fourth pulleys 64, 68 lie is substantially perpendicular to the line along which the axes of second and third pulleys 56, 64 lie.

Roller 60 is mounted between belts 66 and 54. Roller 60 possesses a connector 58 at each of its ends. Connector 58 attaches roller to belts 54 and 66. In the preferred embodiment, the connector 58 is mounted on a connector base 72.

Figure 7:
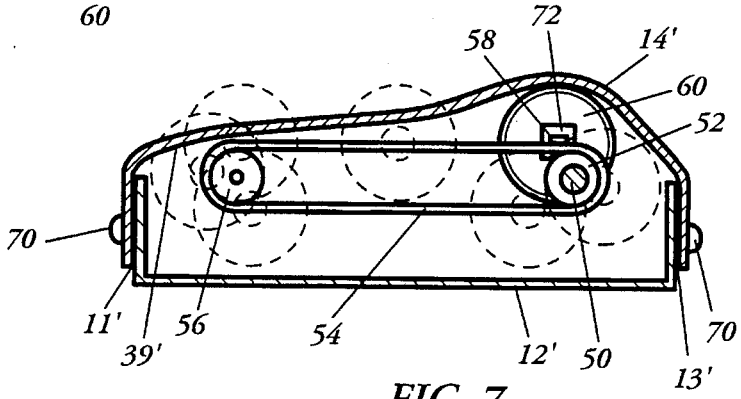
FIG. 7 is a right lateral internal view of a motorized embodiment of the dynamic wrist rest.

Referring now to FIGS. 6 and 7, the operation of the motorized wrist rest 10' is depicted. Speed reducing gear shaft 50 activates first and fourth pulleys 52, 68. First and fourth pulleys 52, 68 in turn activates belts 54, 66. Belts 54, 66 begin to move around first and second pulleys 52, 56 and third and fourth pulleys 64, 68, respectively. Second and third pulleys 56, 64 begin to rotate when the belts 54, 66 move. Pulley connector shaft 76 turns as second and third pulleys 56, 64 turn and functions to insure that second and third pulleys 56, 64 rotate at similar rates, thus improving the efficiency of motion translator movement. Roller 60 is connected to belts 54, 66 using connectors 58. As belts 54, 66 move around the pulleys, roller 60 is moved around the pulleys by belts 54, 66.

Motion translator 78 is mounted within housing 11' so that roller 60 will contact the interior surface 39' of wrist interface 14'. Wrist interface 14' is made of a flexible material and is mounted to wrist interface support wall 13' using attachment means 70. As roller 60 moves along the interior surface 39' of wrist interface 14', the vertical position of wrist interface 14' changes. Thus, the movement of roller 60 around belts 54, 66 and pulleys 52, 56 and pulleys 64, 68 provides for the up and down motion of the wrist interface 14'.

Figure 10:
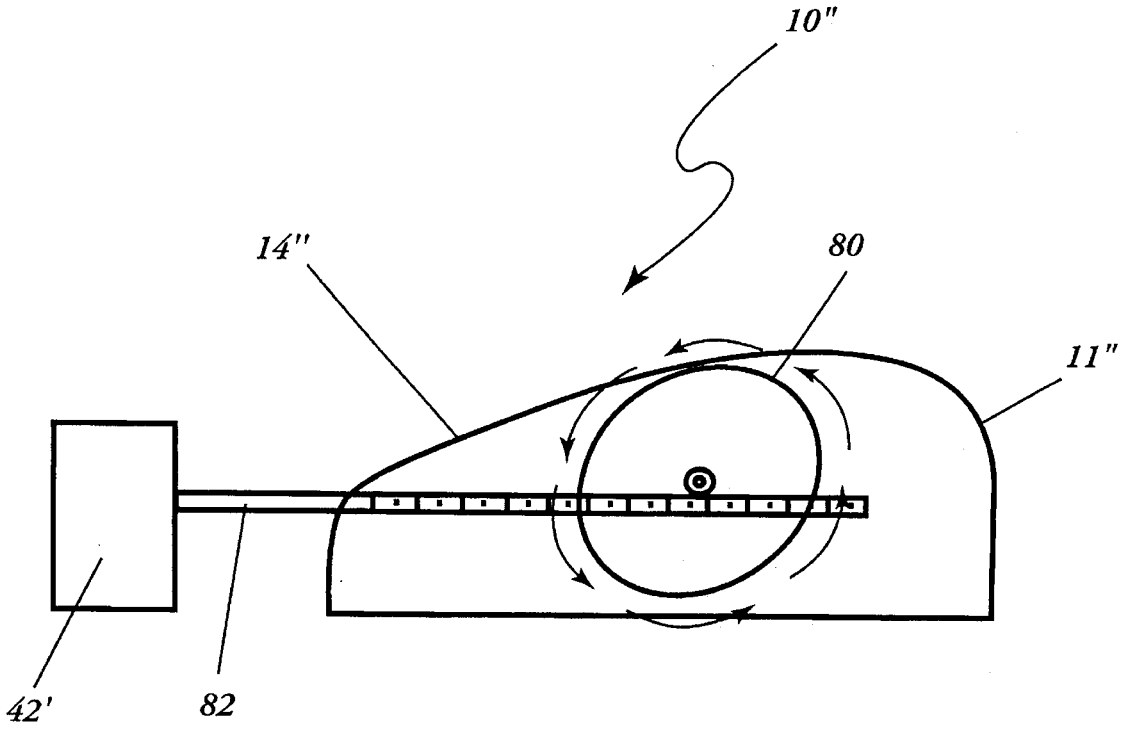
FIG. 10 is a schematic of an alternate embodiment of the motorized dynamic wrist rest.

Referring now to FIG. 10, an alternative embodiment of a motorized wrist rest 10" is depicted. In this embodiment of the invention, vertical motion of wrist interface 14" is provided by the rotation of oval-shaped roller 80. Oval-shaped roller 80 is mounted within housing 11" and is turned by any convenient drive train 82. Drive train 82 is connected to and driven by a motor 42'. As the drive train drives the shaft of the oval-shaped roller 80, the roller will rotate within the housing 11" and cause the wrist interface 14" to raise and lower in an oscillating motion to cause the heels of the palms of the user to raise and lower and change angle during the course of operation of the device.

Thus, although there have been described particular embodiments of the present invention of a new and useful Dynamic Wrist Rest, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What we claim is:

1. A dynamic wrist rest, including:

a. a housing;

b. an expandable bladder combined with said housing to create a substantially air tight internal void space within said expandable bladder;

c. said wrist rest having a top outer surface serving as a wrist interface; and d. means for moving said wrist interface in a piston-like motion in response to static or dynamic pressure.

2. A dynamic wrist rest including:

a. a housing;

b. an expandable bladder combined with said housing to create an internal void space:

c. a portion of said dynamic wrist rest serving as a wrist interface d. means for moving said wrist interface in a reciprocal motion; and e. said means for moving said wrist interface in a reciprocal motion including a port providing for the intake of air into and the expulsion of air out of said void space and means for regulating the flow of air into and out of said void space as pressure is applied to the wrist interface, said regulating means causing air to rapidly fill said void space in response to a reduced pressure on said wrist rest at said wrist interface and to slowly expel air from the void space in the event of increased pressure on said wrist interface.

3. A dynamic wrist rest including:

a. a housing;

b. an expandable bladder combined with said housing to cream an internal void space;

c. a portion of said dynamic wrist rest serving as a wrist interface;

d. means for moving said wrist interface including a roller:

e. means mounting said roller within said housing for movement about a defined path;

f. a motor having a power output;

g. a drive train connected to the power output of said motor;

h. means for causing said drive train to drive said roller along said defined path; and i. the movement of said roller along said defined path causing up and down motion of said wrist interface.

4. The wrist rest according to claim 3 wherein said roller has an axis and at each position of said roller during its travel over its defined path, said axis is parallel to the axis of the roller at every other position of said roller.

5. The wrist rest according to claim 4 wherein said axis moves in a loop as the roller travels along its defined path.

6. A dynamic wrist rest including:

a. a housing;

b. an expandable bladder combined with said housing to cream an internal void space;

c. a portion of said dynamic wrist rest serving as a wrist interface:

d. means for moving said wrist interface including an oblong roller;

e. said oblong roller mounted internally of said void space and having an axis and an outer perimeter, the oblong roller mounted such that a portion of its outer perimeter contacts an interior surface of the wrist interface;

f. a motor; and g. means connecting saint motor to said oblong roller to rotate said roller about its axis.

* * * * *